United States Patent [19]

Pruitt

[11] Patent Number: 4,818,232

[45] Date of Patent: Apr. 4, 1989

[54] TANK GUNNER PROFICIENCY TEST SYSTEM

[76] Inventor: Chris M. Pruitt, 400A Savage Dr., Newport News, Va. 23602

[21] Appl. No.: 125,645

[22] Filed: Nov. 23, 1987

[51] Int. Cl.[4] ..... F41F 27/00

[52] U.S. Cl. ..... 434/23

[58] Field of Search ..... 434/16, 19, 23

[56] References Cited

U.S. PATENT DOCUMENTS

| | | | |
|---|---|---|---|
| 1,269,374 | 6/1918 | Brodstrom | 434/23 |
| 2,378,840 | 6/1945 | Lubicz-Bakanowski et al. | 434/23 |
| 2,571,511 | 10/1951 | Winter | 434/23 X |
| 2,922,233 | 1/1960 | Yoshikawa | 434/23 |
| 4,245,402 | 1/1981 | Lanese | 434/19 |

*Primary Examiner*—William H. Grieb

[57] ABSTRACT

A system for measuring the eye-hand coordination proficiency of a tank gunner/commander. A target board is located some distance away from the tank. A second "recording" board is located near the tank at the muzzle end of the main gun. As the gunner/commander sights a target line on the target board a marking element attached to the gun traces a line on the recording board; the traced line can be used to measure proficiency.

15 Claims, 1 Drawing Sheet

TANK GUNNER PROFICIENCY TEST SYSTEM

GOVERNMENT INTEREST

The invention described herein may be manufactured or used by or for the U.S. Government for Governmental purposes without payment to me of any royalty thereon.

BACKGROUND AND SUMMARY OF INVENTION

In tank warfare the main gun (cannon) on the tank can be controlled by either the gunner or the commander. In either case the person controlling the gun uses a telescope or periscope to sight the moving target and aim the gun. Eye-hand coordination is necessary to achieve a quick and accurate laying and firing of the gun on the target.

This invention relates to a system for measuring the eye-hand coordination (proficiency) of a human tank gunner or tank commander. The system can comprise a target board positioned a predetermined distance (e.g. 80 feet) in front of a military tank; and a recording board positioned in close adjacency to the muzzle end of the tank's main gun. A marking instrument is attached to the muzzle end of the gun to trace a line on the recording board as the human gunner tank commander (within the tank) operates the controls for moving the main gun through elevational and azimuthal motions.

The aforementioned target board has an irregular line thereon representing the motion of a moving target (e.g., enemy truck or tank) some distance from the tank. During a gunner proficiency test the gunner or commander views the irregular line through the primary or auxiliary optical sight (telescope or periscope); he operates the elevation—azimuth hand controls to follow as closely as he can the irregular line on the target board.

The aforementioned marking instrument (attached to the main gun) traces a line on the recording board representative of the gun motion. Gunner or commander eye-hand coordination proficiency is related to the extent that the traced line follows the target line on the target board. Since the target board is spaced much further from the tank than the recording board, the line traced on the recording board will be smaller than (but similar to) the irregular line on the target board; the smaller (shorter) line will be in the nature of a pantographic copy of the larger line.

To conveniently compare the traced line with the target line, the recording board may be pre-printed with a pantographic copy of the target line. The traced line will be imprinted directly over the printed line. Gunner or commander proficiency can be measured as the extent to which the traced line deviates from the printed line.

If desired the pre-printed line can be a line on a transparent "overlay" sheet positionable over the traced line after completion of the proficiency test.

The invention is believed to have the following general advantages:

a. Very low cost system.

b. Provides a printed (permanent) record of gunner/-commander proficiency.

c. Provides a standard test setup usable for competitive testing (one gunner/commander against another).

d. Provides information on the magnitude of gunner/commander error, and the precise motion segments where errors are occurring.

e. Shows gunner/commander whether he is improving (by comparing one print-out with another).

f. Is installable quickly by soldiers having no special training.

g. Can be used where space is limited (e.g., inside the building or in any space about 100 feet in length).

h. Does not require firing the main gun or expending ammunition (low test costs).

i. Poses no safety threat to soldiers nearby (e.g., no laser danger).

j. Test can be carried out by a single soldier on his own initiative (without assistance by others).

k. Permits the gunner/commander to use the actual sight and hand-operated controls that would be used in combat (not a simulated set of controls).

THE DRAWINGS

THE DRAWINGS IN GREATER DETAIL

Figure 1:
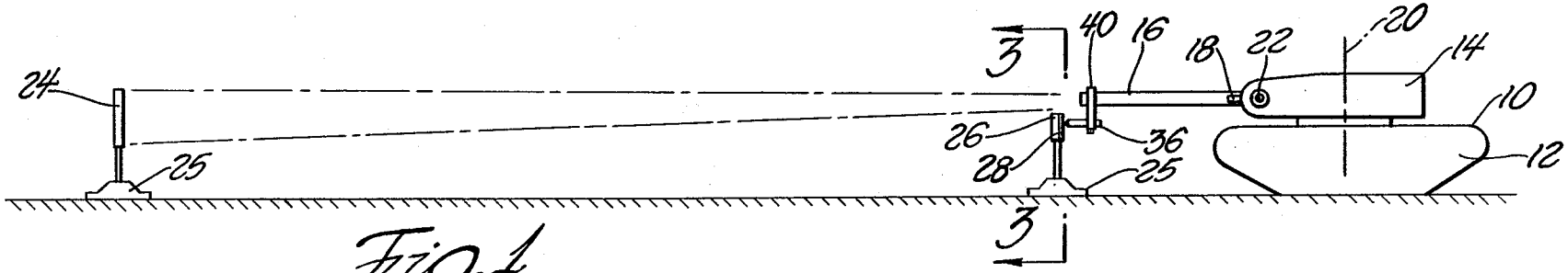
FIG. 1 is a side elevational view of a military tank arranged for a gunner proficiency test, using my improved test system.

FIG. 1 shows a conventional military tank 10 having a hull 12, turret 14, main gun 16, and a primary or auxiliary optical gun sight (telescope or periscope) 18. The gun sight is located alongside the gun at approximately the same level (i.e., on the gun horizontal axis). Power mechanism within the tank permits the gunner/commander to turn the turret around turret axis 20, thereby traversing gun 16 in the azimuth plane. Additional power mechanism, controlled by the gunner/commander, moves the gun in a vertical plane around the gun trunnion axis 22; the gun is thus adjusted in the elevational plane.

During actual combat operations the human gunner/-commander (within turret 14) sights moving enemy targets through primary or auxiliary gun sight 18. He determines the target range (e.g. via a laser range finder) while attempting to maintain his sight on the target; he fires the main gun after the image in the sight has been synchronized to the target motion.

Firing efficiency (time to fire) and accuracy depend to a certain extent on the eye-hand coordination proficiency of the gunner, i.e., the ability of the gunner to rapidly synchronize sight motion to target motion. My invention relates to a system for measuring this eye-hand coordination proficiency of the human gunner/-commander.

SYSTEM DESIGN

The system comprises a target board 24 spaced from tank 10 and a recording board 26 located near the tank (adjacent the muzzle end of gun 16). A marking instrument 36 is carried on the gun to trace a line on board 26 representative of gun 16 motion.

Target board 24 has an irregular line thereon representing a moving enemy target. In a gunner/commander proficiency test, the gunner/commander (in the tank) sets his optical sight at a specific starting point on the line on board 24. He then operates his azimuthal and elevational controls to follow the irregular line on board 24, from the starting point to an end point (the other end of the irregular line).

Gunner/commander proficiency is related to the time required to traverse the line on board 24 and the number of deviations from the line (i.e., instances when the gunner/commander was unable to stay on the line). The gun motion is recorded on board 26. The aim is to have the traced line on board 26 be an exact pantographic (smaller but similar) copy of the line pattern on board 24. Deviations appear as differences in the shape of the traced line versus the target line.

TARGET BOARD 24

In carrying out my invention, I provide an upright stationary target board 24 a predetermined distance from the muzzle end of tank gun 16, e.g. 6 feet or 80 feet. The target board may include a rectangular sheet of paper facing the tank; an irregular (wiggly) line is printed on the paper sheet for viewing by the gunner seated within the tank (through telescopic sight 18).

Figure 3:
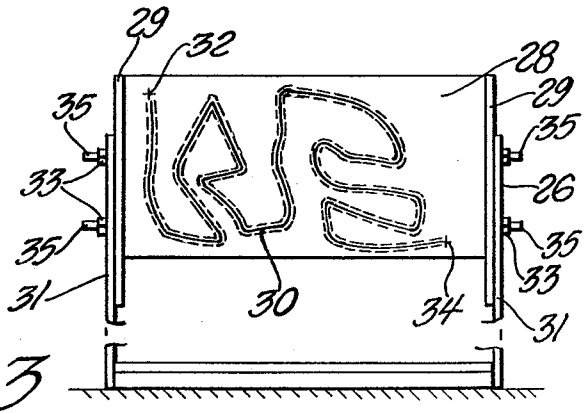
FIG. 3 is an enlarged view taken on line 3—3 in FIG. 1, and showing pre-printed indicia on a recording board used in the FIG. 1 system.

The irregular line o the target board (paper sheet) represents the motion path of an enemy target as it moves into or out of coincidence with the recticle (sight lines) on the telescopic sight eye piece. The irregular line on board 24 has azimuthal and elevational dimensions corresponding to the simulated motion of the target (a moving dot on the line). Typically the irregular line on board 24 would have an azimuthal dimension of about 7 feet and an elevational dimension of about 5 feet. The irregular line may double back on itself a number of times, as shown generally in FIG. 3. FIG. 3 is representative of target board 24 or recording board 26 in that each board can have an irregular target line thereon. The target line can take different configurations representing different target motions.

Board 24 is shown as an upright structure having supporting feet 25 for positioning itself above the terrain surface. However, board 24 can be a building wall, fence, or similar structure that is suitable for mounting a sheet of material thereon. The sheet of material can be paper, cardboard, cloth or other material capable of accepting an irregular line (representing a moving target).

The sheet of material is preferably separate from board 24, whereby a given sheet can be replaced with a different sheet having a differently configured irregular line thereon (representing different target movements. i.e., different directions and speeds)

RECORDING BOARD 26

Figure 2:
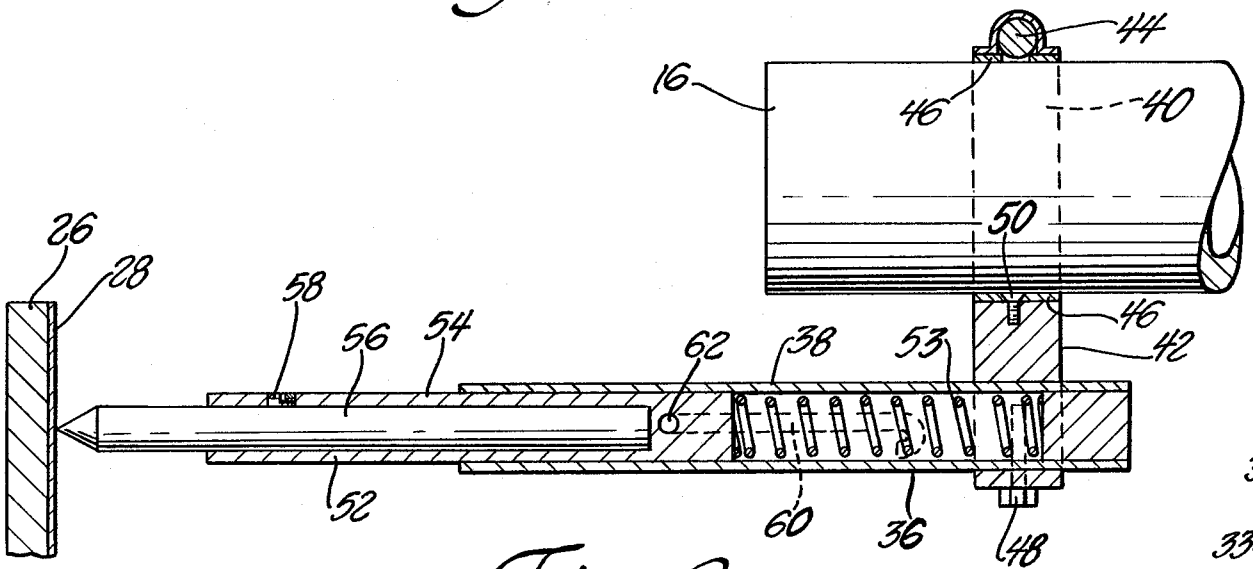
FIG. 2 is an enlarged view of test equipment used in the FIG. 1 system.

An upright recording board 26 is positioned in front of the tank in close adjacency to the muzzle end of main gun 16. Board 26 is generally similar to board 24 except that it may have a somewhat smaller face area. Board 26 has a recording surface facing the tank. As shown in FIG. 2, the recording surface is the exposed face of a paper sheet 28 suitably stapled or taped to the board proper.

Sheet 28 may be a plain sheet devoid of markings. Alternately sheet 28 may have indicia thereon, as shown in FIG. 3. The indicia takes the form of an irregular target line 30 having termination points 32 and 34. One of these points is a starting point, and the other point is an ending point.

During a gunner/commander proficiency test a marking instrument (fastened to the barrel of gun 16) traces a line on sheet 28 in accordance with motions imparted to the gun tube by the human gunner. If sheet 28 has a target line thereon (prior to the test), the gunner's eye-hand proficiency is determined by the extent to which the traced line follows (corresponds to) the target line. If sheet 28 is a blank sheet (no target line thereon) it is necessary to compare the traced line with a target line on a separate master overlay sheet (not shown). The master sheet can be a transparent sheet having an irregular target line thereon; when the transparent sheet is placed over sheet 28 any differences (deviations) between the master line and traced line become apparent.

Board 26 is preferably equipped with some means to adjust the board vertically (prior to a gunner proficiency test). As shown in FIG. 3, the board comprises two vertical bars 29 slidably engaged with upstanding legs 31. Studs 35 extend from bars 29 through slots in legs 31; wing nuts 33 may be tightened onto the screws to clamp bars 29 in adjusted positions on legs 31, as necessary to vertically adjust board 26.

MARKING INSTRUMENT 36

A marking instrument 36 is removably attached to the muzzle end of the gun barrel for imprinting a visible line on sheet 28 (on board 26). The line provides a record of gun tube motion, resulting from the human effort to keep the gun on the target (represented on board 24).

Marking instrument 36 comprises a tubular holder 38 suitably suspended from the gun tube by any convenient mechanism. As shown, the suspending mechanism includes a hose clamp 40 encircling the gun barrel, and a two-piece block 42 attached to the hose clamp for gripment of holder 38. Hose clamp 40 comprises a manual screw 44 having a helical thread engageable in slots in a flexible band 46, for tightening or loosening the band on the gun barrel. The hose clamp may be a known commercial item.

Block 42 comprises upper and lower sections having semi-circular recesses therein conforming to the contour of holder 38. The two sections are connectable together with bolts 48 to tighten the block assembly onto holder 38. Screws 50, or similar attaching devices, may be used to affix the upper block section to band 46. If block 42 is of one-piece construction holder 38 may be affixed to the block via a set screw.

Band 46 is adjusted so that holder 38 is located directly below the gun barrel in a vertical plane coincident with the gun barrel axis. Holder 38 slidably mounts a marking implement 52 for adjusting motions on the holder 38 axis. A compression spring 53 is arranged within holder 38 to bias implement 52 in a leftward direct (FIG. 2).

Implement 52 comprises a socket element 54 and a pen (or pencil) element 56; set screw 58 locks element 56 in the socket element. Element 56 may be replaced, as necessary, to change the color of the line imprinted on sheet 28 or to improve the visibility of the line. Spring 53 provides a biasing force to maintain a desired pressure of the marking implement on sheet 28.

At certain times it may be necessary or convenient to retract the marking implement rightwardly away from the surface of paper sheet 28. A bayonet slot 60 in tubular holder 28 is engaged by a pin 62 that extends outwardly from socket element 54. By manually moving the socket element rightwardly and then turning same around the socket axis it is possible to latch the marking implement in a retracted position spaced from paper sheet 28.

TEST OPERATION

To conduct a gunner/commander proficiency test the target board 24 is positioned a predetermined distance from the muzzle end of gun 16, e.g., 60 feet or 80 feet. The controls are operated so that the appropriate reticle line on the gun sight eyepiece registers with the starting point (32 or 34) on the irregular line on the face of board 24.

Board 26 is then adjusted so that marking implement 52 is engaged at a correct starting point on paper 28 (i.e., a point on paper 28 corresponding to the starting point on board 24). At this time it may be necessary to vertically adjust board 26 and/or move it laterally to obtain the desired registry with implement 52.

A gunner efficiency test may be performed by measuring the time required to traverse the gun sight along the entire length of the line on target board 24. This can be done with a stop watch or equivalent.

During the efficiency test the gunner/commander sights the irregular line on board 24 white operating the tank azimuth and elevational controls to cause the sight recticle to advance along the irregular line on board 24; he attempt to maintain the recticle on the line while moving the gun-sight assembly as fast as possible from the starting point to the ending point. Marking implement 52 traces a line on sheet 28 that records gun motion.

Time to traverse the line on board 24 is a measure of gunner efficiency (time-to-fire); in a typical scenario this time might be on the order of three minutes (depending on length of the line and the number of direction changes therein). In scoring the gunner efficiency, a standard point value (e.g., 100) may be used to represent the expected (average) time to traverse the target motion line on board 24. Points may be added to (or subtracted from) the standard point value, proportional to seconds saved (or lost) relative to the expected time.

The number of deviations from the target line, as recorded by marking implement 52, represents gunner/commander accuracy; a small number of deviations corresponds to a high degree of accuracy, and vice versa.

To avoid misinterpretations on when a deviation has occurred sheet 28 (or a master sheet usable therewith) may have additional lines spaced on either side of the "zero deviation" line. In FIG. 3 these "deviation" lines are shown as dashed lines on either side of the full line representing "no deviation". A deviation occurs when the line traced by implement 52 strays outside the area encompassed by the two dashed lines. Gunner accuracy is inversely related to the number of deviations occuring during a complete traverse of the irregular line on target board 24.

FIG. 3 shows an irregular line 30 having two end points 32 and 34. Either end point can be used as a starting point. If desired, the test can start from one point to the other and then back to the starting point.

The irregularity of line 30 may be selected (varied) to provide different degrees of test difficulty, i.e., an easy test with a short line having only a few line direction changes, and a harder test with a longer line having a greater number of direction changes and more abrupt changes. The test line pattern is changed by replacing the sheet on board 24 with a different sheet.

For any given test the line 30 configuration on board 24 and the line 30 configuration on board 26 (or master sheet) will be similar, except that the line system on board 26 will be somewhat smaller due to the fact that board 26 is closer to the swing axes 20 and 22 which produce gun motion.

In order for test results to be properly comparable (one test versus another) the spacing of board 24 from the tank should be the same in each case. The drawings show board 26 positioned just beyond the muzzle end of gun 16, and board 24 spaced a predetermined distance from board 24. That predetermined distance can vary, e.g., 80 feet for a long-range test, and 40 feet for a short range test.

Board 26 can be located under gun 16 at different points therealong (i.e., nearer the tank) as long as it is below the gun motion orbit. However, board 26 should be spaced some distance from swing axis 22 to obtain a readable traced line (on sheet 28). In some vehicles where the gun tube is relatively short, board 26 would be mounted on the hull area of the vehicle.

The invention is usable on tanks or tank-like vehicles wherein the main gun is mounted in a turret for azimuthal and elevational motions. Following is a partial list of vehicles which can utilize the invention: the United States M-48, M-60 and M-1 Tank, and the M-2 or M3 fighting vehicles: the German Leopard 1 or Leopard 2 Tanks and the Marder vehicle vehicle; the British Chieftan. Challenger or Centurion Tanks; and the Israeli Merkava Tank.

I wish it to be understood that 1 do not desire to be limited to the exact details of construction shown and described for obvious modifications will occur to a person skilled in the art, without departing from the spirit and scope of the appended claims.

I claim:

1. In association with a military tank having a main gun movable in elevation and azimuth by hand action of a human gunner, and an optical gun sight usable by the gunner for gun target acquisition: the improvement comprising a gunner/commander proficiency evaluation means; said evaluation means comprising a target board having indicia thereon representing a moving target: a recording board; and a marking instrument; said recording board being positionable in front of the tank in close adjacenty to the muzzle end of the main gun; said marking instrument being attachable to the main gun for imprinting a visible record of gun motion on the recording board; said target board being locatable a pre-specified distance from the muzzle end of the gun in position to be viewed by the gunner through the optical gun sight.

2. The improvement of claim 1 wherein said marking instrument takes the form of a line-marker.

3. The improvement of claim 1 wherein the target board indicia takes the form of an irregular line having azimuthal and elevational dimensions.

4. The improvement of claim 1 wherein the recording board has indicia thereon representing optical line-of-sight projections from the gun sight to the indicia on the target board.

5. The improvement of claim 4 wherein the recording board has additional indicia thereon representing known deviation from the aforementioned optical line-of-sight.

6. The improvement of claim 1 wherein the target board indicia takes the form of an irregular line having azimuthal and elevational dimensions; the recording board indicia taking the form of an irregular line representing a optical line-of-sight projection from the gun sight to the irregular line on the target board.

7. The improvement of claim 1 wherein the target board includes a paper sheet and the target board indicia takes the form of a printed line on said sheet.

8. The improvement of claim 7 wherein the recording board includes a second paper sheet; said marking instrument comprising a line marker designed to physically contact said second sheet.

9. The improvement of claim 1 wherein said marking instrument comprises a tubular holder and a marking implement slidably mounted in said holder for adjustment in a direction parallel to the axis of the main gun.

10. The improvement of claim 9 and further comprising spring means arranged within the tubular holder to bias the marking implement toward the recording board.

11. The improvement of claim 10 and further comprising latch means for retaining the marking implement in a retracted position against the biasing action of the spring means.

12. The improvement of claim 1 wherein the marking instrument is attachable to the main gun so that it is located directly below the gun in a vertical plane coincident with the gun axis.

13. The improvement of claim 12 wherein the recording board is locatable beyond the muzzle end of the main gun, and the marking instrument projects beyond the muzzle end of the gun to physically contact the recording board.

14. The improvement of claim 12 wherein the marking instrument is spaced a sufficient distance below the main gun that the instrument is continually below the elevational orbit of the optical gun sight.

15. The improvement of claim 1 wherein the recording board is vertically adjustable so that when the optical sight is targeted on a "start" point on the target board the marking instrument will be at a corresponding point on the recording board.

* * * * *